United States Patent [19]

Mathews

[11] Patent Number: 4,922,867

[45] Date of Patent: May 8, 1990

[54] VALVE STOP MECHANISM FOR INTERNAL COMBUSTION ENGINES

[75] Inventor: Will W. Mathews, Glen Ellyn, Ill.

[73] Assignee: Cummins Engine Company, Inc., Columbus, Ind.

[21] Appl. No.: 400,706

[22] Filed: Aug. 30,.1989

[51] Int. Cl.[5] ..... F01L 1/26

[52] U.S. Cl. ..... 123/90.22; 123/90.4

[58] Field of Search ..... 123/90.22, 90.4, 315

[56] References Cited

U.S. PATENT DOCUMENTS

| | | | |
|---|---|---|---|
| 3,633,556 | 1/1972 | Inoue | 123/90.22 |
| 3,963,004 | 6/1976 | Lysinger et al. | 123/90.22 |
| 4,327,677 | 5/1982 | Vander Bok | 123/90.22 |
| 4,343,268 | 8/1982 | Stang et al. | 123/90.22 |

*Primary Examiner*—Charles J. Myhre
*Assistant Examiner*—Weilyn Lo
*Attorney, Agent, or Firm*—Sixbey, Friedman,Leedom & Ferguson

[57] ABSTRACT

A valve actuating mechanism for an internal combustion engine is provided including an integrally formed stop element to limit the axial travel of the valves toward the piston to a predetermined maximum extent in the event an adjacent associated valve becomes stuck and unmovable. The present invention further provides a valve actuating mechanism including a guideless valve bridge with specifically configured contact faces which prevents both the excess axial movement of the valve stem and the transfer of undesired loads to the valve stem or adjacent structures.

15 Claims, 4 Drawing Sheets

VALVE STOP MECHANISM FOR INTERNAL COMBUSTION ENGINES

TECHNICAL FIELD

This invention relates generally to a valve actuating mechanism for an internal combustion engine of the type wherein two valves are operated simultaneously, and, in particular, to a valve stop mechanism for limiting valve travel by the valve actuating mechanism.

BACKGROUND ART

The simultaneous actuation of the pairs of valves associated with a piston in an internal combustion engine is usually achieved by valve actuation mechanism that includes a valve bridge. The valve bridge is actuated by a rocker arm or like structure to contact simultaneously the terminal ends of the stems of the pair of valves and to cause the valves to reciprocate between open and closed positions. As long as both valves in the pair reciprocate freely, the valve actuation mechanism will continue to contact both valve stems simultaneously. Both valves will continue to open and close as required for normal engine operation, and the loads placed on the valve bridge and valve stems by this process will be substantially evenly distributed. If, however, something occurs to interfere with the simultaneous movement of both valves by the valve bridge, distribution of the load on the valve bridge and associated structures is unequal. This can lead to the application of forces and stresses on these structures which could ultimately cause major damage or possibly engine failure.

The simultaneous contact of the valve stems by the valve bridge would not occur if, for example, one of the valves became stuck in a closed position or otherwise rendered immovable during engine operation. In this event, the height of the immovable valve stem would be fixed above the engine block while the height of the movable valve stem would vary. The valve bridge would then forcibly contact the immovable valve stem, but might or might not also contact the movable valve stem. This forcible contact between the valve bridge and valve stem could force the valve bridge out of alignment and transfer undesirable forces to the rocker arm and associated structures. As a result, the prior art has proposed structure to maintain the alignment of the valve bridge and associated components in an attempt to avoid these undesirable loads.

In certain valve actuating mechanisms, the valve bridge is guided intermediate its ends for reciprocating movement to operate a pair of valves in the manner shown, for example, in U.S. Pat. No. 3,963,004, issued June 15. 1976 to Glenn W. Lysinger and James S. Sears and in U.S. Pat. No. 3,633,556, issued Jan. 11, 1972 to Atusushi Inoue. In such guided valve actuating mechanisms, the valve bridge typically includes a machine guide or slider from which extends a shank portion which must slidably engage a guide rod or guide pin secured into the cylinder head of an engine. In addition, separate guide sleeves are also provided for each valve to maintain the axial alignment of the valve during engine operation. Such features of construction, operation and arrangement can render the valve actuating mechanism difficult and expensive to manufacture, and can undesirably add weight to the engine. As a result, guideless valve bridges which eliminate this structure have been proposed.

A valve actuating mechanism of the type in which a guideless valve bridge is used to control operation of a pair of valves in an internal combustion engine is shown in U.S. Pat. No. 4,327,677. issued May 4, 1982 to Arnold Vander Bok. Vander Bok discloses a valve actuating mechanism in which a guideless valve bridge and a pair of valves are provided with cooperating means whereby alignment of the valve bridge relative to the valves is maintained and the valve bridge is permitted to automatically compensate for any variation in valve stem height. This valve actuating mechanism eliminates some of the problems associated with previously available mechanism. However, a serious concern remains with this type of guideless valve bridge. In the event that one of the two valves sticks to its associated valve seat in the closed position, the remaining non-sticking valve in the pair will complete an opening stroke which is nearly twice the distance of a normal opening stroke at twice the typical rate of acceleration. This can lead to collisions between the valve and the piston with the potential for major and possibly catastrophic internal engine damage. None of the known valve actuating mechanisms includes structure that will prevent such an occurrence.

Thus, there is a need for a valve actuating mechanism of the type including a guideless valve bridge for a valve stop structure which limits the maximum travel during the opening stroke of each of the valves, thereby preventing collisions between the valves and the pistons and reducing the potential for internal engine damage.

DISCLOSURE OF THE INVENTION

It is a specific object of the present invention to overcome the disadvantages of the prior art and to provide a valve actuating mechanism for an internal combustion engine including valve stop structure which limits the maximum travel during the opening stroke of the valves.

It is another object of this invention to provide a valve actuating mechanism for an internal combustion engine which will effectively prevent collisions between the valves and the pistons and reduce the potential for internal engine damage.

It is yet another object of the present invention to provide a valve actuating mechanism for an internal combustion engine that includes structure for limiting the maximum opening stroke of the valves which is simple and inexpensive to manufacture and install.

It is a further object of the present invention to provide a valve stop mechanism for an internal combustion engine including structure which directs the application of force away from weak areas in the valve actuating mechanism in the event a valve becomes immovable for any reason.

Still another object of the present invention is to provide valve travel limiting structure which, in the event that one of the valves in a pair sticks in the closed position, places additional load on the valve actuating mechanism in a manner that permits the stuck valve to break free from its associated valve seat or causes a failure in a portion of the guideless valve actuating mechanism which avoids any contact between the non-sticking valve and the piston.

These and other objects and advantages of the present invention are achieved, by providing, in conjunction with a valve actuating mechanism of the type with a guideless valve bridge to control the operation of a pair of valves in an internal combustion engine, a valve travel stop means for limiting the maximum travel of the valves during the opening stroke. This valve stop means includes a mid stop valve guide and valve spring retainer mounted circumferentially about each valve stem. Each valve guide has a length selected to arrest the force applied by the valve bridge to the valve stem should one valve in a pair become stuck and to prevent the movement of each valve toward the piston beyond a predetermined maximum open position. The present invention also provides load directing structure which directs the application of forces associated with valve actuation to a portion of the valve stop structure capable of bearing the load in the event that one of the valves becomes stuck or is otherwise rendered immovable during engine operation.

From the following description taken in conjunction with the accompanying drawings, the present invention, including other objects, details and advantages thereof, will become apparent to those of ordinary skill in the art.

BEST MODE FOR CARRYING OUT THE INVENTION

Figure 1:
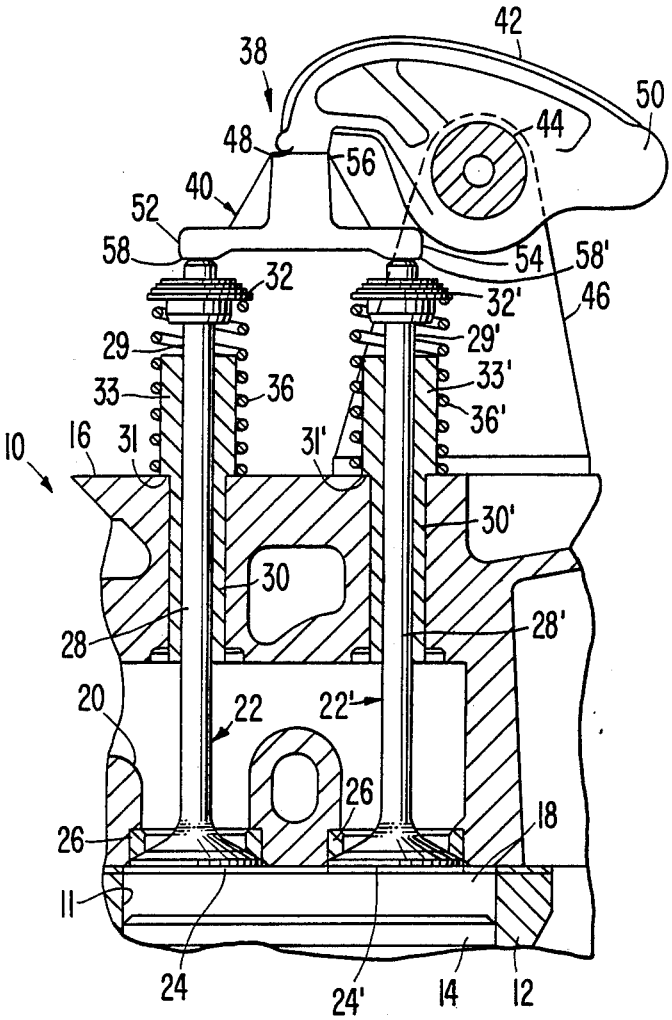
FIG. 1 is a cross-sectional view through a portion of an internal combustion engine showing a pair of valves, a valve bridge, and a portion of the valve actuating mechanism which operates the pair of valves in accordance with a preferred embodiment of the invention.

FIG. 1 illustrates a portion of an internal combustion engine, such as a diesel engine, generally designated 10, which includes a cylinder block 12 with at least one cylinder bore 11 in which is mounted a reciprocating piston 14. A cylinder head 16 mounted on the cylinder block 12 closes the upper end of the cylinder bore to form an expandable combustion chamber 18 with the reciprocating piston 14. The cylinder head 16 is provided with a passage 20 opening into the combustion chamber 18. The flow between the passage 20 and the chamber 18 is controller by two spaced apart poppet type valves 22 and 22'. Each of the valves 22 and 22' has a head, 24, 24' which is adapted to seat against an associated valve seat 26, 26' mounted in the cylinder head 16 to define a port.

Each of the poppet valves 22,22' has a stem 28,28' which is reciprocably mounted in a valve sleeve 30,30' press fitted in a mounting or valve sleeve bore that extends through the cylinder head 16 and intersects the passage 20. The valve sleeves 30,30' extend outwardly of the cylinder block and terminate a predetermined distance short of the ends of valve stem ends 29,29', as will be explained below.

Each valve sleeve 30,30' has a configuration that fixes it in place in the head and prevents its movement in a longitudinally axial direction toward the piston 14. In the construction shown, each of the valve sleeves 30,30' is stepped to form a shoulder 31,31'. The shoulder has an outer diameter which is greater than the outer diameter of the portion of the valve sleeve 30,30' which is press fitted within the cylinder head 16 so that the shoulder abuts against the cylinder head surface. The portion 33,33' of each valve sleeve that extends beyond the head preferably is the same diameter as that of the shoulder 31,31' of each valve sleeve. The shoulder 31,31' on each valve sleeve 30,30' thus functions as a stop and prevents the axial movement of the valve sleeve toward the piston 14 when force is applied to the top of the valve sleeve. Although the valve sleeve configuration shown is referred, other configurations that include a stop element, such as, for example, a circumferential flange, that will contact the cylinder head surface and prevent movement of the sleeve toward the piston could also be used.

Figure 2:
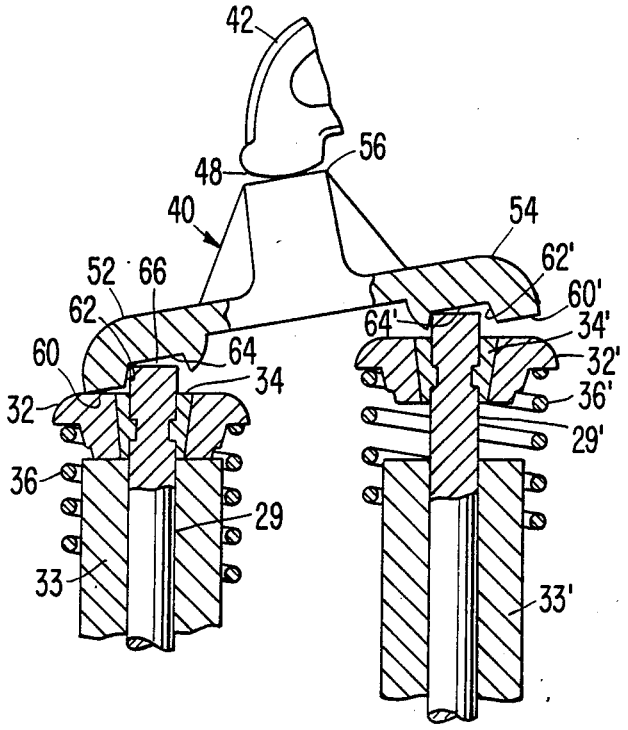
FIG. 2 is an enlarged cross-sectional view of a portion of a valve actuating mechanism showing a second embodiment of a valve stop portion of a valve actuating mechanism according to the present invention.

The upper or free end 29,29' of each valve stem 28,28' extends a predetermined distance beyond each valve sleeve 30,30' to engage a valve bridge in a manner to be described in detail below. A cap 32,32' is secured to the upper end 29,29' of each valve stem 28,28' by suitable structure, such as the valve keeper 34,34' shown in FIG. 2. The cap 32,32' may be spaced a distance from the terminal end of the valve stem as shown in FIG. 1 or may be almost flush with the terminal end as shown in FIG. 2.

Each valve 22,22' is normally maintained in a closed position with the valve head 24,24' seated against its associated valve seat 26,26' by a return spring 36,36'. Each return spring 36,36' encircles the upper portion 29,29' of a valve stem and extends from the cap 32,32' to the cylinder head 16. One end of the spring 36,36' abuts against the cylinder head, and the other end of the spring engages cap 32,32'. The cap may be any conventional spring cap or retainer 32,32' suitably secured to the stem of each poppet valve 22,22' by suitable means. For example, if a valve keeper is used to fasten the cap to the valve stem, it may be in the form of conically tapered split keys (not shown) which are held on the groove end of the valve stem by wedging action of a cooperatively tapered portion of the cap 32. Any other similar holding means may also be employed, however.

In a typical internal combustion engine the poppet valves 22,22' are adapted to be actuated in unison between their closed and open positions relative to their respective valve seats 26,26' by the operation of a valve actuating mechanism indicated generally at 38. In the construction shown, the valve actuating mechanism 38 is mounted at the terminal ends 29,29' of the valve stems 28,28' and includes a rocker arm 42. A guideless multivalve actuating valve bridge 40 is operatively positioned between the valve actuating mechanism 38 and the ends 29,29' of the valve stems 28,28' for simultaneously moving the valves 22,22' between their maximum open and fully closed positions. The guideless valve bridge 40 is unrestrained and "floats," which permits its reorientation in response to uneven valve opening displacement, should any such uneven displacement occur. The rocker arm 42 is typically pivotably journaled intermediate its ends on a shaft 44 which is supported above the cylinder head 16 by a bracket 46 suitably secured to the cylinder head. One end of the rocker arm 42 is provided with a tappet portion 48 which engages the upper portion of the valve bridge 40 to effect the reciprocable movement of this valve bridge. The opposite end 50 of the rocker arm 42 is connected to a push rod or like structure which transmits movement from the engine camshaft to the rocker arm and, ultimately, to the valves.

The valve bridge 40 includes a pair of arms 52 and 54 spaced from and extending transversely of a central upstanding rocker arm engaging tappet head 56. Each of the arms 52 and 54 is provided on its surface opposite the tappet head 56 with a suitable contact surface. This may be the arcuate or semi-spherical pallet 58 shown or some other construction which will engage the surface of each end 29,29' of the valve stems 28,28'. The upper surfaces of valve stems 28,28' may be contoured to receive the pallets 58,58' or may be substantially planar. The contour selected must maintain positive contact between the valve stems and the valve bridge during engine operation.

FIG. 2 illustrates an alternate embodiment of the present invention which minimizes the likelihood that contact between the valve bridge and valve stems will be maintained. In place of the pallet 58, each of the arms 52 and 54 of the valve bridge 40 may be provided on the surface facing the valve stem with a cap contact face 60,60', which is cut at an angle. Each arm 52,54 is also provided with a central guide bore 62,62' and a valve stem contact face 64,64' at the innermost extent of the guide bore. The inside diameter of the guide bore 62,62' is preselected to be larger than the outside diameter of each valve stem 28,28'. The size of the guide bore should provide a suitable radial clearance to accommodate the floating reorientation of the valve bridge 40. The angled configuration of the cap contact face permits positive contact between the valve stem and the valve stem contact face when both valves are functioning properly and moving freely. The advantages of a valve bridge of this specific construction will be discussed below in connection with the operation of the present invention.

Figure 3:
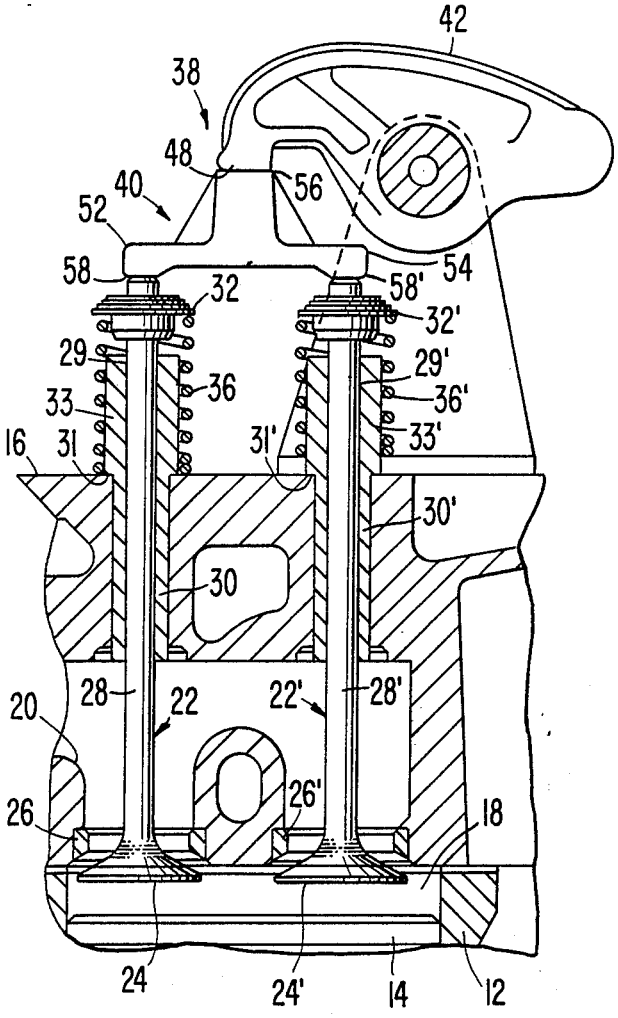
FIG. 3 is a cross-sectional view of the portion of the internal combustion engine of FIG. 1 showing the valves in an open position.
Figure 4:
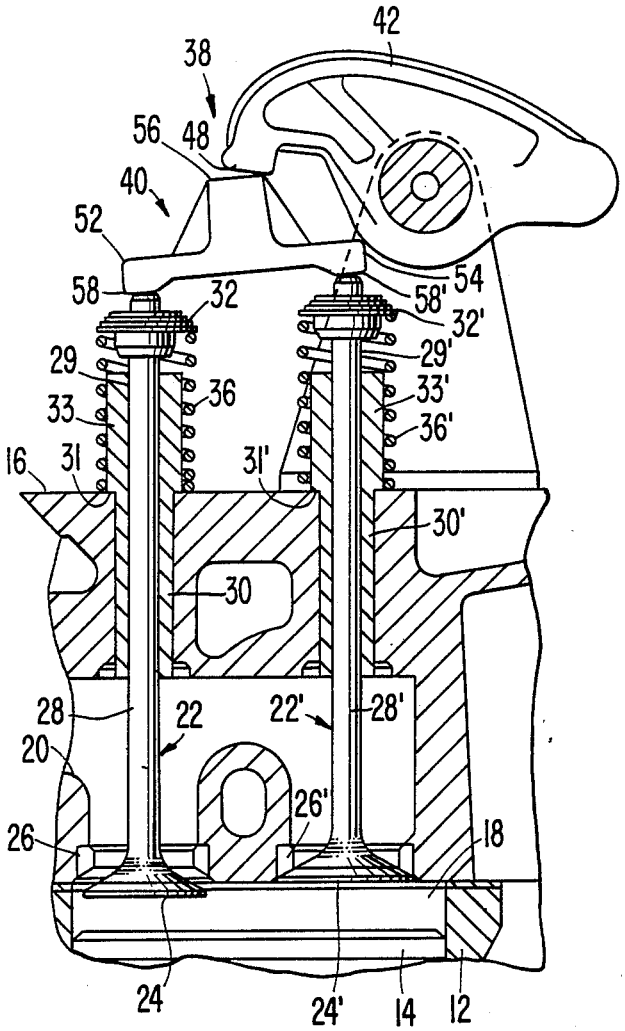
FIG. 4 is a cross-sectional view of the portion of the internal combustion engine of FIG. 1 showing one valve stuck in a closed position.

The valve actuating mechanism of the present invention functions effectively to limit the maximum extent of travel toward the piston of one of a pair of valves while avoiding engine damage in the event that the other valve becomes stuck in its seat. Should this occur, adjacent valve stems will extend different distances beyond the valve sleeves and, therefore, contact the valve bridge differently or not at all. This will cause the guideless type of valve bridge to become misaligned and contact the unstuck valve stem in a manner that is likely to apply more force than is desirable. Moreover, this force could be applied to a weaker part of the valve stem. The result of the application of such a force could drive the valve toward the piston at a high rate of acceleration so that collision with the piston is highly likely. In addition, an undesirably increased load is placed on the valve bridge and may be transmitted to adjacent structures, such as the rocker arm, push rod or associated structures. FIGS. 1, 3 and 4 illustrate how the present invention avoids these undesired events.

In FIGS. 1 and 3, the valve bridge 40 is positioned to contact the upper ends 29,29' of the valve stems 28,28' of the valves 22,22'. Both stems 28,28' extend substantially the same distance beyond the valve sleeves 30,30'. In FIG. 1, the valves are shown in the normal closed position; in FIG. 3, the valves are shown in the normal open position.

In FIG. 4, one of the pair of valves, valve 22' is stuck in the closed position with valve head 24' engaging the valve seat 26'. As a result, the upper end 29' of valve stem 28' extends farther beyond its valve sleeve 30' than does valve stem end 29 of valve 22. This causes the tappet portion 48 of the rocker arm 42 to engage only one edge of the upper surface 56 of the valve bridge 40. This results in the valve bridge 40 pivoting about the point of contact between the pallet 58' and the upper end surface of the valve stem 29'. With this pivoting action, the pallet 58 of arm 76 forces valve 22 to travel downwardly toward the piston 14 beyond the normal open position illustrated in FIG. 3 and, typically, at about twice the normal rate of acceleration. Valve 22 would therefore be forced to travel about twice the distance of its normal opening stroke and possibly even further unless some means is provided to limit the valve travel.

The present invention provides valve travel stop structure which simply and effectively limits the axial travel of the valve toward the piston in the event that one valve becomes stuck or some other malfunction of the associated structures causes the valve bridge to pivot. As discussed above and shown in conjunction with FIGS. 1. 3 and 4, each of the valve sleeves 30,30' within which the valve stems 28,28' reciprocate is formed with an integral shoulder 31,31' which contacts the surface of the cylinder head 16 when the sleeve is fitted into the head and thus prevents movement of the sleeve toward the piston. The large diameter portions 33,33' of each valve sleeve receive the valve return springs 36,36', which are supported in place around the circumference of the valve sleeve portions 33,33' between caps 32,32' and the upper surface of head 16.

The springs 36,36' normally bias the valves 22,22' in the closed position of FIG. 1. In this position, the caps 32,32' are spaced a predetermined distance from the top portions 33,33' of the valve sleeves. During the engine cycle when the valves are open, as shown in FIG. 3, the valve bridge 40 simultaneously contacts and forces both valve stems toward the piston 14 so that the valve heads 24,24' are unseated from valve seats 26,26'. Return springs 36,36' are then compressed between caps 32,32' and the cylinder head. During this part of the engine cycle, the caps 32,32' do not contact the tops of the valve sleeves 33,33', but are spaced a distance beyond the sleeves even when the valves have been moved a sufficient distance axially toward the piston to move the valves to an open position.

FIG. 4 illustrates the operation of the valve travel limiting feature of the present invention when valve 28' is stuck in the closed position. As discussed above, in the event this occurs, the valve bridge 40 forces the valve stem 28 toward the piston 14. However, the axial travel of the valve 22 is limited to a predetermined distance. Ideally, this predetermined distance will ensure that the valve head 24 stops significantly short of the piston 14 to eliminate any possibility of a collision with the piston. Valve 22 is shown in FIG. 4 in its maximum travel position. The cap 32 on the upper end 29 of the valve stem 28 has been forced into contact with the top surface of the large diameter portion 33 of the valve sleeve 30. The valve sleeve 30, in distinct contrast to prior art valve sleeves, will not move axially toward the piston with the valve stem. Shoulder 31 functions as a stop so that if any axial movement does occur, it will be stopped when the should 31 contacts the outside surface of the cylinder head 16. The axial movement of valve 22' toward the piston 14 would similarly be limited by the stop function of shoulder 31' on valve sleeve 30' if valve 22 became stuck.

When the spring retainer or cap 32 contacts the top surface of the valve sleeve portion 33, the load initially absorbed by the valve stem 28 during the pivoting action of the valve bridge 40 is transferred from the valve stem 28 to the valve bridge 40. This transfer of the load may result in the arm 54 exerting sufficient force on the valve stem 28' to cause it to break free from the fully closed stuck position to an open position. Alternatively, it may result in a transfer of load from the valve bridge 40 to the valve actuating mechanism 38, which could induce a failure or breakage in the valve actuating mechanism 38. This failure or breakage would occur either in the rocker arm 42, the push rod, or some other component of the valve actuating mechanism 38. This failure or breakage in the valve actuating mechanism 38, moreover, is likely to absorb the load from the valve bridge.

The valve bridge embodiment shown in FIG. 2 transfers the load created by a stuck valve in a somewhat different manner than the valve bridge shown in FIGS. 1, 3 and 4. In the event valve 22' becomes stuck or is rendered immovable for any reason, the cap contact face 60 will engage the upper surface of spring retainer or cap 32. This causes a mechanical fuse or lock between the valve bridge 40 and the cap 32 and transfers the load from the valve stem end 29 and valve keeper 34 to the cap 32. The force or load will thus be transferred from the cap 32 to the flat point of contact between the cap contact face and the top surface of the cap 32.

Consequently, the load is effectively transferred to the strongest structures surrounding the valve. These structures are able to absorb this force without breakage. This effectively avoids the application of shearing forces directly to either the valve stem 29 or the valve keeper 34, which are weaker and may not be able to withstand such a load. In addition, the abutment of contact face 60 against cap 32 leaves a clearance space 90 between the end of the valve stem end 29 and the valve stem contact face 64. The effect of this is to prevent contact between the valve bridge and the valve stem, which additionally prevents movement of the non-sticking valve toward the piston.

During the pivoting action of the valve bridge 40, the clearance between the valve bridge 40 and the top of the valve stem 29 of the non-sticking valve 22 increases as the angle of the bridge 40 becomes more acute. This also allows the spring retainer or cap 32 to absorb the force or load from the cap contact face 60 of the valve bridge 40 without any contact taking place between the valve stem contact face 64 and the valve stem end 29 of the non-sticking valve 22 when the valve bridge 40 reaches the conclusion of its pivoting action and fully contacts the spring retainer 32. Thus, the spring retainer 32 prevents the force or load from being transferred to the valve stem 29 and valve keeper 34 of the non-sticking valve. In the event contact by the valve bridge 40 should cause the spring retainer 32 to slide along the valve stem 29 toward the cylinder head 16, the valve sleeve large diameter portion 33 would prevent the spring retainer 32 from pushing the valve 22 beyond the predetermined maximum open position. Any contact between the valve 22 and the piston 14 is also prevented. Moreover, because the force is diverted from the valve stem to the valve stop, more force may be applied to the "stuck" valve to try to free it.

The predetermined maximum open position may be conveniently defined by the point at which the bottom surface of the spring retainer 32,32' abuts against the top surface of the valve sleeve wide diameter portion 33,33'. Thus, the valve sleeves 30,30' are positioned to limit the amount of pivoting action or the degree of floating reorientation of the valve bridge 40 should one of the valves 22,22' become stuck. The length of the valve sleeves 30,30', therefore, is selected to arrest movement of the valve bridge 40 at a location which will prevent either one of the pair of valves 22,22' from contacting the piston if the other valve in the pair should stick to its valve seat 26,26' or should be rendered immovable for any other reason.

The valve lift between the fully closed and normal open positions of a valve in a conventional internal combustion engine is typically a distance of about 0.400 inches. In accordance with a preferred embodiment of the invention, the predetermined maximum open position may be be located at a distance of between 0 and 0.200 inches below the normal open position of each valve 22,22' (i.e., between 0.400 and 0.600 inches below the closed position). or preferably at a distance of between 0.005 and 0.040 inches below the normal open position (i.e., between 0.405 and 0.440 inches below the closed position). It is of critical importance that a predetermined maximum open position be established for the valves 22,22' which provides a minimum clearance between the valve heads 24,24' and the piston 14. The valve stop structures must then be sized and positioned accordingly. If this is done as described herein, collisions between the valves and the pistons will be prevented, and the potential for serious internal engine damage significantly reduced.

Industrial Applicability

The present invention will find its primary applicability in various types of internal combustion engines, such as diesel engines, of the type wherein two valves are simultaneously operated by a common guideless valve bridge. It will be apparent to those of ordinary skill in the art that the present valve stop mechanism can be of wider applicability and may find use in numerous other environments wherein it is desired to limit valve travel in a valve actuating mechanism.

Furthermore, in addition to a wider range of applicability than the specific embodiments disclosed herein, it will also be apparent to those of ordinary skill in the art that the present invention is susceptible to various changes and modifications without departing from the essence of the present invention. Therefore, it is intended that the present invention be viewed as encompassing such embodiments, modifications and changes as are encompassed by the scope of the following claims.

I claim:

1. A valve stop mechanism for an internal combustion engine of the type having a cylinder head, at least one piston, and at least one pair of spaced apart valves, each valve having a valve stem slidably received in the cylinder head and extending outwardly therefrom for movement from a fully closed position to a predetermined maximum open position, a valve actuating means mounted in spaced relation from the stems of the valves for moving the valves between said open and closed position, and a guideless multi-valve actuating valve bridge operatively positioned between the valve actuating means and the free ends of the valve stems for simultaneously moving said valves between their fully closed and predetermined maximum open positions, wherein said valve stop mechanism comprises valve bridge movement arresting means associated with each valve for preventing opening movement of each valve beyond said predetermined maximum open position, wherein said multi-valve actuating valve bridge is unrestrained to permit floating reorientation thereof in response to uneven valve movement.

2. A valve stop mechanism according to claim 1, wherein said valve bridge movement arresting means is positioned to limit the degree of floating reorientation of said multi-valve actuating valve bridge should one of said valves become immovable.

3. A valve stop mechanism according to claim 2, wherein said valve bridge movement arresting means comprises a valve sleeve associated with each one of said pair of valves.

4. A valve stop mechanism according to claim 3, wherein each said valve sleeve has a length selected to arrest movement of said multi-valve actuating valve bridge at a predetermined location should one of said pair of valves become immovable.

5. A valve stop mechanism according to claim 4, wherein said valve sleeve includes shoulder means for preventing movement of the valve sleeve axially toward said piston.

6. A valve stop mechanism according to claim 5, wherein said shoulder means contacts said cylinder head to fix said valve sleeve in a longitudinally axial position relative to said piston.

7. A valve stop mechanism according to claim 6, further including spring retainer means secured to each said valve stem for retaining spring means for biasing said valve stem in said closed position, wherein said multi-valve actuating valve bridge is positioned to abut against said spring retainer means in the event that one of said pair of valves sticks in the fully closed position.

8. A valve stop mechanism according to claim 7, wherein said multi-valve actuating valve bridge includes at least one contact face, wherein said contact face forcibly contacts said spring retainer means should an adjacent valve stick in the fully closed position.

9. A valve stop mechanism according to claim 8, wherein the abutment of said contact face against said spring retainer provides a minimum clearance between said multi-valve actuating valve bridge and the stem of the non-sticking valve, thereby preventing said multi-valve actuating valve bridge from contacting said non-sticking valve stem and moving said valve.

10. A valve stop mechanism for an internal combustion engine including valve stop means for limiting the axial movement toward the piston of one of a pair of valves in said engine to a predetermined maximum length of travel when the other of said pair of valves is rendered unmovable during engine operation.

11. A valve stop mechanism as described in claim 10, wherein each of said valves moves reciprocably within a valve sleeve and said valve stop means comprises stepped shoulder means formed integrally with said valve sleeve for contacting the outer surface of said engine to fix said valve sleeve in an axial position relative to the piston.

12. A valve stop mechanism as described in claim 11, further including contact means mounted on the stem of each of said valves for contacting a valve sleeve of one of said valves in response to forces exerted on said valve stem in the event the other of said valves is rendered unmovable during engine operation.

13. A valve stop mechanism for an internal combustion engine with valve actuation structure including guideless valve bridge means for reciprocably moving a pair of valves between closed and open positions, said valve stop mechanism including valve stop means for limiting the movement of said valves to a predetermined maximum distance in said open position, wherein said valve stop means is located circumferentially about a stem of each of said valves and includes force diverting means for absorbing forces generated by said valve bridge means when one of said valves is rendered immovable during engine operation and diverting said forces from said valve stem to said valve stop means.

14. A valve stop mechanism as described in claim 13, wherein said valve stop means includes a valve sleeve configured to engage the surface of the head of said engine and cap means secured to said valve stem for contacting said valve sleeve when the valve has been moved said predetermined maximum distance.

15. A valve stop mechanism as described in claim 13, wherein said force diverting means includes valve stop contact means on said valve bridge configured to contact said valve stop means and to avoid contact with the stem and structures immediately adjacent to the stem of one of said valves in the event the other of said valves is rendered immovable.

* * * * *